US006669020B1

(12) United States Patent
Mamiye

(10) Patent No.: US 6,669,020 B1
(45) Date of Patent: Dec. 30, 2003

(54) RESEALABLE BLISTER BREATH STRIP CASE

(76) Inventor: Marc J. Mamiye, 2402 Central Ave., Aberdeen, NJ (US) 07747

( * ) Notice: Subject to any disclaimer, the term of this patent is extended or adjusted under 35 U.S.C. 154(b) by 0 days.

(21) Appl. No.: 10/281,242

(22) Filed: Oct. 28, 2002

(51) Int. Cl.[7] ..... A61B 17/06
(52) U.S. Cl. ..... 206/438; 206/467; 206/471
(58) Field of Search ..... 206/438, 440, 206/441, 461, 462, 467, 468, 469, 470, 471, 484, 484.11, 494

(56) References Cited

U.S. PATENT DOCUMENTS

D294,558 S * 3/1988 Adams et al. ..... D9/415
D295,832 S * 5/1988 Shelton ..... D9/415
D319,843 S * 9/1991 Thornell ..... D19/2
5,184,724 A * 2/1993 Mayled ..... 206/466
D350,479 S * 9/1994 Livezey ..... D9/415
5,758,775 A * 6/1998 Lowe ..... 206/571
6,053,320 A * 4/2000 Kuethe ..... 206/462
6,273,610 B1 * 8/2001 Koyama et al. ..... 383/207
6,513,655 B2 * 2/2003 Logan et al. ..... 206/469
6,615,986 B2 * 9/2003 Pirro et al. ..... 206/704

* cited by examiner

*Primary Examiner*—Shian Luong
(74) *Attorney, Agent, or Firm*—Charles I. Brodsky

(57) ABSTRACT

A resealable case including a clear blister compartment, a plurality of oral breath strips within the compartment, a rear flap having an opening for accessing the compartment to individually remove the breath strips, and an adhesive surface on the flap for closing and exposing the opening through the folding and unfolding of the rear flap, respectively.

8 Claims, 1 Drawing Sheet

RESEALABLE BLISTER BREATH STRIP CASE

STATEMENT REGARDING FEDERALLY SPONSORED RESEARCH OR DEVELOPMENT

Research and development of this invention and Application have not been federally sponsored, and no rights are given under any Federal program.

CROSS-REFERENCE TO RELATED APPLICATIONS

NONE

REFERENCE TO A MICROFICHE APPENDIX

NOT APPLICABLE

BACKGROUND OF THE INVENTION

1. Field of the Invention

This invention relates to oral breath strips, in general, and to a resealable case for the easy carrying about of such breath strips, in particular.

2. Description of the Related Art

As is well known and understood, the use of oral breath strips as mouth fresheners is gaining wider acceptance through advertising and through word-of-mouth recommendations. Commonly made available for sale in 24 or 30 strip packages, a need has been determined to exist to make their carrying case easy to handle and store in one's pocket or purse in allowing for retail sale at reasonable cost. Besides advantageously having a feature of "tamper-proof" construction in affording a degree of security in use, cases of these types also would benefit from an ability to allow removal of individual strips in a sanitary fashion—all in an easy and simple manner.

SUMMARY OF THE INVENTION

As will become clear from the description that follows, such a breath strip case according to the invention includes a clear blister compartment, a plurality of oral breath strips within the compartment and a rear flap having an opening for accessing the compartment to individually remove the breath strips one by one; an adhesive surface is then provided on the rear flap for closing the opening upon the folding over of the flap. In a preferred embodiment of the invention, the adhesive surface is selected of a composition to expose the opening upon the unfolding of the rear flap, in allowing the blister case to be resealable in usage.

In one construction of the invention, the adhesive surface is arranged to form an outline about the opening for securing the rear flap in place. This outline may be of a curvature substantially similar to a reverse curvature included on the rear flap—such as a downward curvature of the outline, as compared to an upward curvature on the rear flap. In providing for a pleasing appearance, moreover, the rear flap which closes the blister compartment is selected of a length to provide an overlap thereof—and for ease of use, the rear flap includes a foil barrier of pliable material. To provide for "tamper-proof" operation, a peel-off sheet is included secured to the adhesive surface—so as to close the access opening before any initial removal of the individual oral breath strips. Only by peeling away the sheet will access be allowed, in affording a degree of security that the breath strip case has not previously been opened—while, at the same time, allows for an arrangement of an attractive presentation for retail sale of the breath strip case in an on-counter or similar store display.

BRIEF DESCRIPTION OF THE DRAWINGS

These and other features of the invention will be more clearly understood from a consideration of the following description, taken in conjunction with the accompanying drawings, in which.

DETAILED DESCRIPTION OF THE INVENTION

Figure 1:
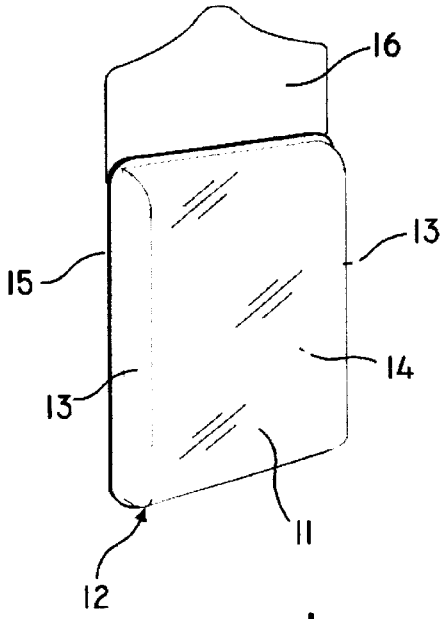
FIG. 1 is front view of the resealable blister breath strip case of the invention as it might be displayed for retail sale.

Referring to the Drawings, the case 10 of the invention includes a clear blister compartment 12 enclosed at its front 11 and sides 13 in housing a plurality of oral breath strips 14. The back 15 of the blister compartment 12 is closed off by a rear flap 16 having an opening 18 for accessing the front compartment 12 to individually remove from the compartment individual ones of the breath strips 14, one-by-one. An adhesive surface on the flap 16 is provided for closing the opening 18 upon the folding over of the flap in the direction of the arrow A. Such adhesive surface, shown at 20, is selected of a composition to expose the opening 18 upon the unfolding of the flap 16, in the direction of the arrow B.

Figure 2:
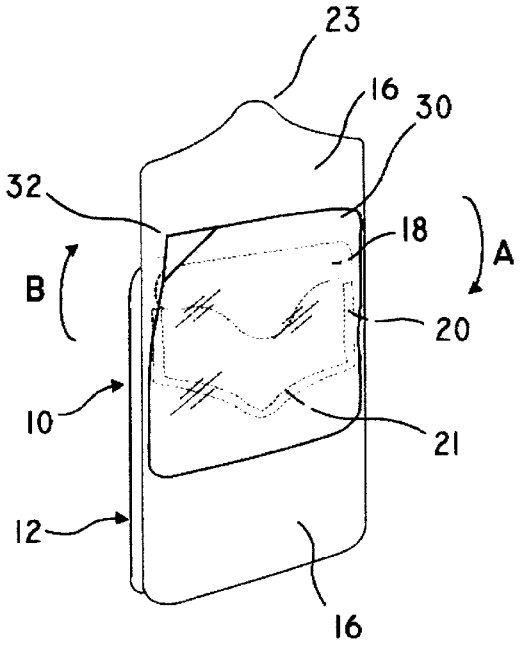
FIG. 2 is a rear view of the breath strip case with its flap open, helpful in an understanding of the invention.
Figure 3:
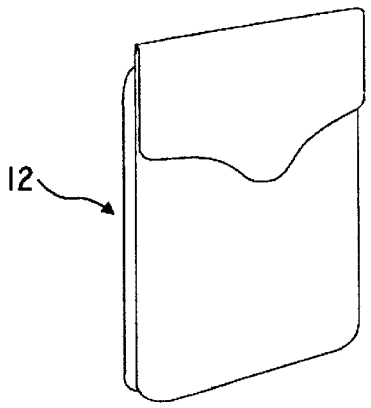
FIG. 3 is a rear view of the resealable blister breath strip case with its flap closed, ready for carrying about in one's pocket or purse.

As shown in FIGS. 2 and 3, the adhesive surface 20 forms an outline about the opening 18 of a curvature which is substantially similar to a reverse curvature included on the rear flap 16. Such curvature of the adhesive surface 20, in a preferred embodiment of the invention, is of a downward curvature, essentially U-shaped, as at 21, to correspond with an upward curvature of the flap 16, shown as 23. When thus folded over, the rear flap 16 closes off the opening 18 in sealing the case 10, in providing the appearance of FIG. 3. Unfolding the flap 16 provides the appearances shown in FIGS. 1 and 2, wherein the opening 18 is exposed in allowing access to be had to the oral breath strips 14 within the compartment 12. As will be appreciated, in accomplishing this, the rear flap 16 closes off the opening 18 in a length providing an overlap beyond such opening. To facilitate this, the flap 16 includes a foil barrier of a pliable material.

To prevent tampering with the resealable blister breath strip case of the invention, and so as to provide an indication to a consumer whether the case 10 has previously been opened prior to purchase, a peel-off sheet 30 is provided, secured to the adhesive surface 20 in initially closing the opening 18 at the outset, at the point of sale. Such sheet 30 may include a legend at a corner 32, instructing one to "peel off here", for example, in allowing access to the opening 18 once removal of the sheet 30 is made. Absence of the sheet 30, initially, then conveys the advice in well known manner that there may well have been prior tampering with the oral breath strips 14 within the compartment 12. At the same time, such peel-off sheet 30 allows retail store sales counter display of the breath strip case when arranged as in FIG. 1 in a box or upon cash register pegboard presentations. Essentially, the sheet 30 allows a sales presentation of the form of FIG. 1, instead of with the rear flap 16 folded downwardly in sealing off the strips of the case from removal.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A breath strip case comprising:

a clear blister compartment;

a plurality of oral breath strips within said compartment;

a rear flap having an opening for accessing said compartment to individually remove said breath strips therefrom;

and an adhesive surface on said rear flap for closing said opening upon the folding over of said flap.

2. The breath strip case of claim 1 wherein said adhesive surface is of a composition to expose said opening upon the unfolding of said rear flap.

3. The breath strip case of claim 2 wherein said adhesive surface forms an outline about said opening for securing said rear flap.

4. The breath strip case of claim 3 wherein said outline is of a curvature substantially similar to a reverse curvature included on said rear flap.

5. The breath strip case of claim 4 wherein said outline is of a downward curvature substantially similar to an upward curvature included on said rear flap.

6. The breath strip case of claim 4 wherein said rear flap closes said blister compartment in a length providing an overlap thereto.

7. The breath strip case of claim 6 wherein said rear flap includes a foil barrier of pliable material.

8. The combination of claim 1, also including a peel-off sheet secured to said adhesive surface closing said opening.

* * * * *